US009053891B2

(12) United States Patent
Derhaeg et al.

(10) Patent No.: US 9,053,891 B2
(45) Date of Patent: Jun. 9, 2015

(54) MOUNTING SYSTEM FOR SEALING AND ALIGNING THE BURNER OF THE LAMP AT THE CENTRE OF ITS BASE

(71) Applicant: Flowil International Lighting (Holding) BV, Amsterdam (NL)

(72) Inventors: Lode Derhaeg, Diest (BE); Frank Broeders, Heverlee (BE); Marc Willems, Baal (BE); James Hooker, Aarschot (BE); Peter Derwael, Borgloon (BE)

(73) Assignee: Flowil International Lighting (Holding) BV, Amsterdam (NL)

( * ) Notice: Subject to any disclaimer, the term of this patent is extended or adjusted under 35 U.S.C. 154(b) by 0 days.

(21) Appl. No.: 13/950,534

(22) Filed: Jul. 25, 2013

(65) Prior Publication Data

US 2015/0028736 A1 Jan. 29, 2015

(30) Foreign Application Priority Data

Jul. 25, 2012 (IN) ..... 2309/DEL/2012

(51) Int. Cl.

| | |
|---|---|
| ***H01J 5/16*** | (2006.01) |
| ***H01J 5/50*** | (2006.01) |
| ***H01J 5/60*** | (2006.01) |

(52) U.S. Cl.

CPC ..... *H01J 5/60* (2013.01)

(58) Field of Classification Search

CPC ..... H01J 5/50; H01J 5/56; H01J 5/58; H01J 5/565

USPC ..... 313/39, 25, 26, 318.02–318.12, 313/612–643

See application file for complete search history.

(56) References Cited

U.S. PATENT DOCUMENTS

| | | | | |
|---|---|---|---|---|
| 2,174,682 | A * | 10/1939 | Beggs | 174/17.07 |
| 4,292,564 | A * | 9/1981 | Kuhnert et al. | 313/318.11 |
| 4,630,880 | A | 12/1986 | Durand | |
| 5,420,474 | A | 5/1995 | Schmitt, Jr. et al. | |
| 6,469,428 | B1 | 10/2002 | Thiel et al. | |
| 7,791,259 | B2 * | 9/2010 | Arndt et al. | 313/318.1 |
| 8,079,741 | B2 * | 12/2011 | Stark | 362/457 |
| 2012/0274199 | A1 * | 11/2012 | Becht et al. | 313/113 |

FOREIGN PATENT DOCUMENTS

| | | |
|---|---|---|
| EP | 0261722 B1 | 3/1988 |
| EP | 0688639 B1 | 8/1995 |

* cited by examiner

*Primary Examiner* — Tracie Y Green

(57) ABSTRACT

A lamp having a longitudinal axis, comprising of a burner pinched at one end and a cement less base holding the contact points protruding from the burner. At least one end of the burner is sealed and aligned at the centre of the base in an upright direction following the lamp axis by means of a spring clip, which is mounted from the side of the pinch of the burner and does not interfere with the lead wires.

11 Claims, 5 Drawing Sheets

MOUNTING SYSTEM FOR SEALING AND ALIGNING THE BURNER OF THE LAMP AT THE CENTRE OF ITS BASE

This application claims the benefit of Foreign Application No. 2309/DEL/2012, filed Jul. 25, 2012, the entire contents of which are incorporated by reference herein.

FIELD OF THE INVENTION

The present invention relates in general, to a cement less base for the lamp. More particularly, the present invention provides a cement less base adapted with a spring clip for sealing and aligning the burner of the lamp at the centre of the base.

BACKGROUND OF THE INVENTION

Conventionally, in lamp technology, the base of the lamp is attached to the burner by cement. Also referring to FIG. 1 of the accompanying drawings, this ceramic suspension (8) is applied between the lamp base (3) and the burner of the lamp (1). After application, this suspension needs to be dried out (at a higher temperature e.g. 150° C.) to harden it. The formulation of this suspension is critical to have the right strength and stability over the life of the lamp. In case of flawed formulation, the cement can start crumbling and the lamp will become loose at the base.

Also, the heating process to dry and harden the cement is critical for its strength and stability. In case said process is done hastily, the suspension can "boil", leaving larger air bubbles in the hardened cement. Applying the cement is a time consuming process as one needs to prepare the mixture, apply the suspension to the base of the lamp while burner is inside the base, allow the cement to dry and also clean the spilt cement from the lamp and also clean the used tools before cement hardens.

Publication no. EP0668639 relates to a bulb socket comprising a bulb receptacle and at least one contact fitting arranged in the bulb receptacle, wherein the bulb receptacle comprises at least one support portion for supporting the contact fitting and being deflectable upon insertion/withdrawal of a bulb into/from the bulb socket. According to a second aspect of the invention, a bulb socket is provided comprising a bulb receptacle and at least one contact fitting arranged in the bulb receptacle, wherein the contact fitting comprises movable contact means movable upon insertion/withdrawal of a bulb into/from the bulb socket and extending over or through an adjacent side wall of the bulb receptacle such that the movable contact means can be bent outwardly. In this publication, the clip is used for electrical contact, and it is used in longitudinal direction.

U.S. Pat. No. 5,420,474 relates to a press sealed lamp focusably mounted in a base. A focusable lamp comprises lamp capsule, coupler, and a base. The capsule is formed with rigid leads. The capsule and coupler are further formed to allow capsule to be held in the coupler and still focused with respect to the coupler. The coupler also includes an internally projecting tab that is sufficiently near one lead that despite movement of the lead during focusing, the gap between the lead and tab may be bridged by solder to thereby electrically and mechanically fix the lamp capsule to the coupler. The coupler and second lead are further aligned and connected to a base. No cement is needed to position the lamp capsule. In this patent differently designed clip is being used inside the base with the objective of electrically connecting the burner and hence there is a risk of electrical breakdown when high voltage is used as for discharge lamps.

U.S. Pat. No. 4,630,880 relates to the tab protruding from a primary electrical contact means in a snap-in terminal for urging contact with misaligned filament wires of a wedge-base bulb. The invention improves electrical contact between the bulb and terminal and allows the terminal to be used in a socket housing made from soft vinyl material. A tab protruding from a primary electrical contact means in a snap-in terminal for urging contact with misaligned filament wires of a wedge-base bulb. The vent tube is cylindrically shaped and centrally located on wedge-base in the longitudinal axis of bulbular evacuated chamber. The centrally located cylindrically shaped vent tube separates two side wings of the wedge base. The side wings encapsulate the filament wires and also have a concave detent trough. The troughs are perpendicular to the vent tube. This patent explains the improvement of the electrical contact.

Publication no. EP0261722 relates to the electric lamp that has a lamp vessel which is fixed by means of cement in a lamp cap of synthetic material. A metal ring in contact with the cement is present in the lamp cap. As a result of this, the cement can be secured by inductive heating of the metal ring. The lamp cap has a spacer member, for example in the form of projections on the inner side of the lamp cap, by which the metal ring is separated from the lamp cap. This publication uses cement in this design as a metal ring is placed inside the cement to aid curing it (inductively heated).

U.S. Pat. No. 6,469,428 relates to the lamp bulb made from glass which is sealed at one end by a pinch. A base is fastened on the pinch by means of a metal spring. The base has a holder loosely adapted to the pinch. The metal spring is bent in a U-shaped fashion and comprises a base part and two limbs which embrace the pinch, the fastening of the base being accomplished by virtue of the fact that one limb is aligned essentially parallel to the longitudinal axis, but simultaneously has a transverse extent 5 to 20% larger than the transverse extent of the holder of base. However, said patent discloses a U-shaped clip that fits around the base of a press seal to hold the bulb in the base wherein one of the limbs has lateral ends which is rolled in. The burner has two lead wires and the clip is attached between them. This clip is mounted over the bottom of the burner. This design cannot be used for lamps with a return lead beside the burner as in the present disclosure.

The said EP patent requires, inter alia, a U-shaped metal spring comprising a based part and two arms, where the arms embrace the pinch of a bulb with at least one of the arms being aligned parallel to the longitudinal axis of the bulb, and where the base of the metal spring runs centrally between the two supply leads of the bulb with at least 3 mm clearance from each supply lead.

Also in the mechanical arrangement, there is possibility of a short circuit between the leads passing by the metal clip as shown in FIG. 1 of said EP patent. If the positioning is not good, the burner can be out of line because it is only held on the bottom in the base and the positioning in horizontal or longitudinal direction in the base is not under control.

Thus, the conventional system does not provide proper alignment of the lamp in the center of the base. Also, the conventional clips cannot be used for lamps where position of the burner is more critical e.g. photo-optic lamps. Hence there exists a need of a mounting system for mounting and aligning the burner in the center of the base, which will be cost-effective, efficient and time saving.

With all the above discussed restrictions or limitations, it is essential to have a cement less base for the lamp.

SUMMARY OF THE INVENTION

The principal object of the present invention is to obviate the above drawbacks and provide a mounting system for sealing and positioning the burner of a lamp in the center of its base.

Another object of the present invention is to provide cement less base for the lamps and to avoid possible electrical short circuits in the base of the lamp.

Yet another object of the present invention is to provide a mechanical base adapted with a specially designed spring clip for the lamps which can be mounted from the side of the burner, thus not interfering with the lead wires and improve the alignment of the burner in horizontal and longitudinal direction.

To achieve the above objectives, the preferred embodiment of the present disclosure provides a lamp having a longitudinal axis, comprising of a burner pinched at one end and a cement less base in the form of a trough-shaped holder to hold the contact points protruding from the burner. At least one end of the burner is sealed and aligned at the centre of the base in an upright direction following the lamp axis by means of a spring clip, which is mounted from the side of the pinch of the burner and does not interfere with the lead wires.

The clip makes the insertion of burner easy in the base and keeps the burner locked in it.

The spring clip has limbs which gets engaged inside the base and makes the clip static.

According to an aspect of the disclosure, the cementless base can also be used for single ended lamp i.e. with only one lead wire coming out of the pinch of the bulb.

BRIEF DESCRIPTION OF THE DRAWINGS

The aforementioned aspects and other features of the present disclosure will be explained in the following description, taken in conjunction with the accompanying drawings, wherein.

Figure 1:
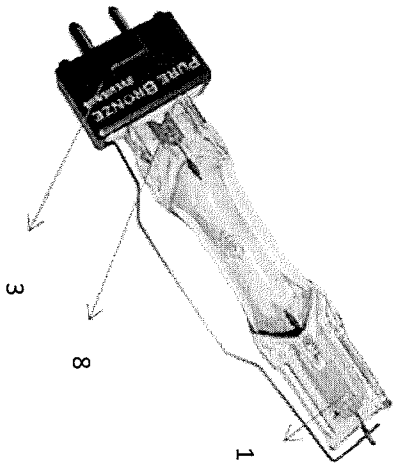
FIG. 1 shows a cemented base for mounting the lamp, according to the conventional art.

While the disclosure will be described in conjunction with the illustrated embodiment, it will be understood that it is not intended to limit the disclosure to such embodiment. On the contrary, it is intended to cover all alternatives, modifications and equivalents as may be included within the spirit and scope of the disclosure as defined by the appended claims.

DESCRIPTION OF THE PREFERRED EMBODIMENTS

The embodiments of the present disclosure will now be described in detail with reference to the accompanying drawings. However, the present disclosure is not limited to the embodiments. The present disclosure can be modified in various forms. Thus, the embodiments of the present disclosure are only provided to explain more clearly the present disclosure to the ordinarily skilled in the art of the present disclosure. In the accompanying drawings, like reference numerals are used to indicate like components.

Figure 2:
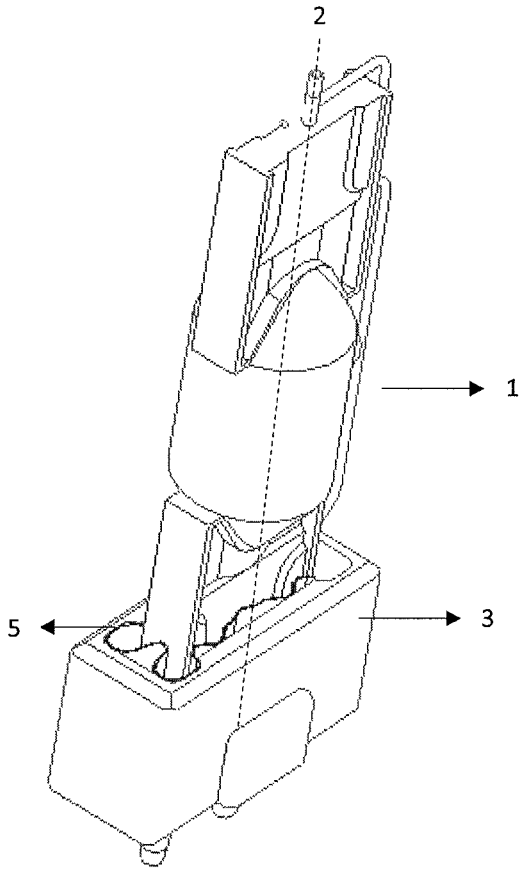
FIG. 2 shows a lamp with cement less base, according to an embodiment of the present disclosure.

Reference may be made to FIG. 2 which shows the lamp (1) with the cement less base (3), according to an embodiment of the present disclosure. The lamp (1) is provided with or without an outer bulb, which has a longitudinal axis (2). The burner of the lamp is sealed or pinched at one end which has at least one supply lead (4) guided outward on the end. The base (3) is in the form of a trough-shaped holder to hold the contact points of supply lead (4) protruding from the burner. The one end of the burner of the lamp (1) is sealed and positioned at the centre of the base (3) in an upright direction following the lamp axis by means of a spring clip (5). The clip is mounted from the side of the pinch (9) of the burner and does not interfere with the lead wires. This arrangement avoids possible electrical short circuits in the base (3) because the spring clip (5) does not contact or occupy the space below the burner in the lamp. The clip (5) replaces the cement being used in conventional lamp bases for positioning of the burner. The said clip (5) is mounted from the side of pinch (9) of the burner to align it at the centre in the base and in an upright direction following the lamp axis. The clip does not interfere with the lead wires.

Figure 3:
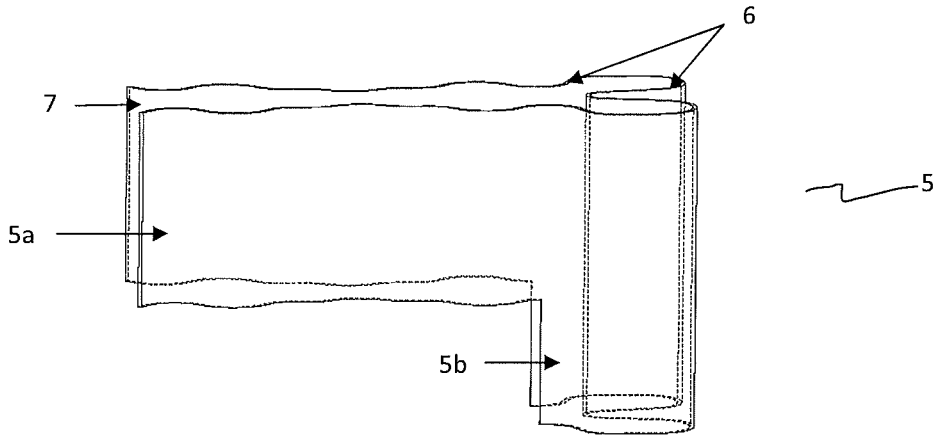
FIG. 3 shows the spring clip for mounting the burner inside the base of the lamp, according to an embodiment of the present disclosure.

FIG. 3 illustrates the spring clip (5) for fastening and positioning the burner of the lamp (1) inside the base (3), according to the present disclosure. The spring clip (5) has two conjoined limbs (5*a*, 5*b*), which gets engaged inside the cement less base and enables mounting of the lamp from the top side of the base. The first limb (5*a*) extends in a direction transverse to the longitudinal axis (2) of the lamp and the second proximate limb (5*b*) is disposed in a direction parallel to the longitudinal axis of the lamp. The assembly being such, that the two limbs (5*a* and 5*b*) may be disposed in a direction somewhat perpendicular to each other. According to FIG. 4, the second limb (5*b*) runs along one side of the wall of the base (3) to the bottom of the base and controls the insertion length of the lamp in the base (3). The limbs (5*a*, 5*b*) have a continuous hollow opening (7) for mounting said clip from the side of the pinch (9) of the burner and avoiding interference with the lead wires.

The clip (5) has a plurality of indentations (6) on the sides transverse to the longitudinal axis of the lamp for facilitating spring action. The indentations provided on the sides of the clip may be wave-like, zigzag, in the form of recesses or any other desired shape. The spring clip (5) is made of any resilient material and preferably by spring steel.

The base (3) is a trough-shaped holder made of any non-limiting material like ceramic, steatite, metal or any other desired material, wherein the burner of the lamp is sealed into it by a form fit or spring force exerted by spring clip (5) that is mounted from the side of the pinch (9) of the burner.

The shape of the base (3) is such as but not limited to the rectangular, circular, oval, square or any other trough-shaped holder. Correspondingly, the shape and size of the clip is also adapted according to the shape and size of the lamp base. For the clip to be fitting inside the base, its width and height are compatible to the inside dimensions of the base.

Figure 4:
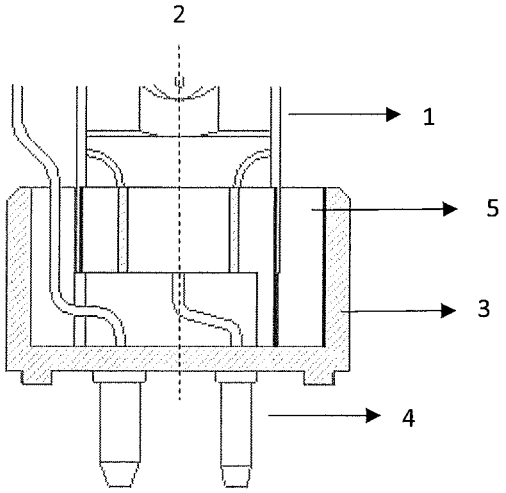
FIG. 4 shows the cross-section view of the base mounting the burner of the lamp with the help of a spring clip, according to an embodiment of the present disclosure.

Referring to FIG. 4, the limb (5*b*) of the clip (5) runs along one side of the wall of the base (3) extending to the bottom of the base (3) to control the insertion length of the lamp in the base (3). The limbs (5*a* and 5*b*) get engaged inside the base by form fit or spring force and thereby making the clip (5) static inside the base (3). The contact points (4) between the burner of the lamp (1) and the base (3) are as high as possible inside the base (3). The corresponding shape and size of the clip (5) adapted according to the shape and size of the lamp base (3) complement each other and force the burner in the center of the base (3). The clip (5) positions and mounts the lamp (1) from the top side of the base (3).

Figure 5:
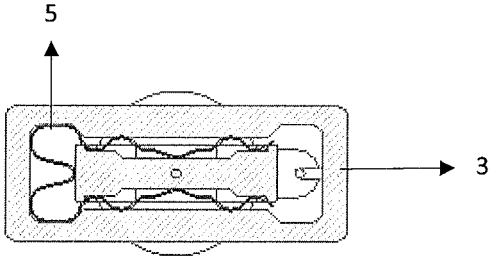
FIG. 5 shows the cross-sectional top view of the lamp, according to an embodiment of the present disclosure.

FIG. 5 illustrates the cross-sectional top view of the lamp burner (1) being sealed and aligned at the centre of the cement less base (3) with the help of a spring clip (5). The continuous hollow opening (7) of the spring clip (5) holds the lamp from the side of the pinch (9) of the burner and the indentations (6) ensure spring action.

Figure 6:
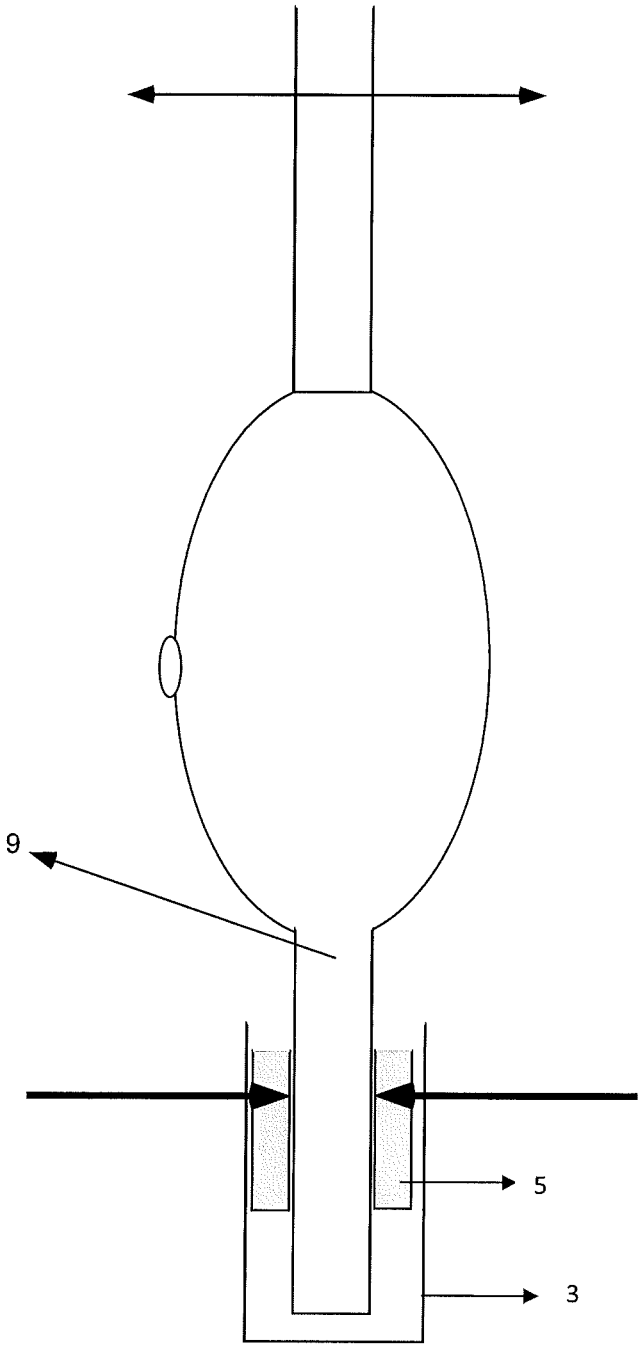
FIG. 6 shows the cross-sectional side view of the lamp, according to an embodiment of the present disclosure.

The positioning of the burner is illustrated in FIG. 6. The positioning and alignment of the burner in the centre of the base is improved with the help of spring clip (5) of the present disclosure in both horizontal and longitudinal directions. The clip does not interact with the base of the pinch (9). It engages the pinch higher in base (3) and forces the burner of the lamp to be aligned at the centre of the base.

In an embodiment of the present disclosure, the present mounting system of cementless base (3) and spring clip (5) can be used for single ended lamp i.e., with only one lead wire coming out of the pinch of the bulb. This design can also be used for lamps with a return lead beside the burner.

The mounting system according to the present disclosure is suitable to be used for bodycare or photo-optic lamps or any other lamp.

The spring action of the clip (5) avoids cracking of the burner due to expansion by heating and thereafter cooling down. The clip (5) considerably reduces the mounting time to mount the burner in a base and thereby reducing the cost together with enhancing the quality of the finished product. Thus, the use of cement less base makes the process faster and assures better positioning of the burner by the spring clip (5).

It is to be noted that the present invention is susceptible to modifications, adaptations and changes by those skilled in the art. The various embodiments described above can be combined to provide further embodiments. Such variant embodiments employing the concepts and features of this invention are intended to be within the scope of the present invention, which is further set forth under the following claims.

Generally, the terms used in claims should not be construed to limit the claims to the specific embodiments disclosed in the specification and the claims, but should be construed to include all possible embodiments along with the full scope of equivalents to which such claims are entitled. Accordingly, the claims are not limited by the disclosure.

We claim:

1. A lamp having a longitudinal axis, comprising of a burner pinched at one end, and a cement-less base in the form of a trough-shaped holder to hold contact points of supply lead protruding from the burner, wherein, at least one end of the burner is sealed and aligned at the center of the cement-less base in an upright direction following the longitudinal axis by means of a spring clip; wherein said spring clip: (a) is mounted from a side of the pinch of the burner; (b) does not occupy the space below the pinch of the burner in the cement-less base; and (c) does not interfere with lead wires.

2. The lamp as claimed in claim 1, wherein the spring clip does not interact with the cement-less base of the pinch and engages the pinch higher in the cement-less base.

3. The lamp as claimed in claim 1, wherein the spring clip seals and aligns one end of the burner at the center of the cement-less base by a form fit or spring force.

4. The lamp as claimed in claim 1, wherein the spring clip has a first limb and a second limb, which gets engaged inside the cement-less base and mounts the lamp from a top side of the cement-less base.

5. The lamp as claimed in claim 4, wherein the first limb extends in a direction transverse to the longitudinal axis of the lamp and the second proximate limb is disposed in a direction parallel to the longitudinal axis of the lamp.

6. The lamp as claimed in claim 5, wherein the second limb runs along one side wall of the cement-less base extending to a bottom of the cement-less base and controls an insertion length of the lamp in the cement-less base.

7. The lamp as claimed in claim 5, wherein the first limb and the second limb have a continuous hollow opening for mounting said spring clip from the side of the pinch of the burner.

8. The lamp as claimed in claim 5, wherein the spring clip has a plurality of indentations on sides transverse to the longitudinal axis of the lamp.

9. The lamp as claimed in claim 1, wherein the shape and size of the spring clip is adapted according to inside dimensions of the cement-less base.

10. The lamp as claimed in claim 1, wherein the spring clip is made of a resilient material.

11. The lamp as claimed in claim 10, wherein the spring clip is made of spring steel.

* * * * *